US006725793B2

(12) United States Patent
Lee et al.

(10) Patent No.: US 6,725,793 B2
(45) Date of Patent: Apr. 27, 2004

(54) BOBBIN FOR SEWING MACHINE

(75) Inventors: Sang Cheol Lee, Seoul (KR); Sung Il Lee, Seoul (KR)

(73) Assignee: Kobest Co., Ltd., Seoul (KR)

( * ) Notice: Subject to any disclaimer, the term of this patent is extended or adjusted under 35 U.S.C. 154(b) by 0 days.

(21) Appl. No.: 10/344,364

(22) PCT Filed: Aug. 27, 2001

(86) PCT No.: PCT/KR01/01444

§ 371 (c)(1),
(2), (4) Date: Feb. 11, 2003

(87) PCT Pub. No.: WO02/18694

PCT Pub. Date: Mar. 7, 2002

(65) Prior Publication Data

US 2003/0167990 A1 Sep. 11, 2003

(51) Int. Cl.[7] ..... D05B 59/00; B65H 75/14
(52) U.S. Cl. ..... 112/279; 112/231; 242/118.41
(58) Field of Search ..... 112/231, 180, 112/188, 196, 228, 229, 230, 279, 302; 242/118.4, 118.41, 118.6, 118

(56) References Cited

U.S. PATENT DOCUMENTS 2,340,574 A * 2/1944 Ashworth ..... 242/118.4
5,078,331 A * 1/1992 Mardix et al. ..... 242/118.41
5,622,127 A * 4/1997 Chang ..... 112/279
6,170,416 B1 * 1/2001 Gulsby ..... 112/279
6,311,912 B1 * 11/2001 Chang ..... 242/118.41

* cited by examiner

*Primary Examiner*—Ismael Izaguirre
(74) *Attorney, Agent, or Firm*—Dykema Gossett PLLC

(57) ABSTRACT

A bobbin for a sewing machine which is rotatably disposed in a rotary shell device of the machine to supply and under thread when performing a sewing operation, comprises of winding shaft separately inserted onto a fixed shaft of the rotary shuttle and on which the under thread is substantially wound, a first flange integrally formed at one end of the winding shaft, a second flange integrally formed at the other end of the winding shaft, and a partition flange forming a first winding portion between the first flange and the partition flange and forming a second winding portion between the second flange and the partition flange, a plurality of saw-toothed protrusions being formed at an entire outer circumference of the partition flange, and the protrusions having a linear sidewall that is oriented in a radial direction of the partition flange.

1 Claim, 6 Drawing Sheets

BOBBIN FOR SEWING MACHINE

TECHNICAL FIELD

The present invention relates to a sewing machine, and more particularly, a bobbin for a sewing machine, in which an under thread is stably pulled out without entanglement or cut of the under thread.

BACKGROUND ART

Generally, a sewing machine, as shown in FIG. 1, has a rotary shuttle device for supplying an under thread. The rotary shuttle device comprises an outer shuttle which is disposed at a driving shaft 1 rotatably connected to a power generating unit, an inner shuttle 3 which is received in the outer shuttle 2, a bobbin 4 which is received in the inner shuttle 3 and on which the under thread is wound, and a bobbin case 5 for receiving the bobbin 4. The bobbin 4 is comprised with a cylindrical winding shaft 4*a* on which the under thread is wound, and a flange 4*b* which is fixed to both end of the winding shaft 4*a* to restrict a winding amount of the under thread.

However, a maximum amount or a maximum thickness of the under thread substantially wound on the bobbin 4 is set to a maximum amount that the under thread wound around a descending point of a sewing needle is not contacted with the sewing needle during a sewing operation. In a convention bobbin, an amount of the under thread wound on the bobbin is very much restricted due to a reason set forth above. Therefore, since a user or an operator has to frequently replace an empty bobbin with a new one, there is a problem that the efficiency in a sewing operation is lowered.

Recently, in order to solve the problem of the conventional bobbin, i.e., be capable of winding a much more amount of the under thread on the bobbin, as shown in FIG. 2, there has been proposed a bobbin 6 in which a winding region of the under thread is divided into two portions. The bobbin 6 having two winding regions is provided with a first flange 6*b* having a relatively large diameter which is formed at one end of a winding shaft 6*a*, and a second flange 6*c* having a relatively small diameter which is formed at the other end of the winding shaft 6*a*. Particularly, at a center portion of the winding shaft 6*a*, there is formed a partition flange 7. A trough portion 7*a* and a ridge portion 7*b* are alternately formed at an outer circumference of the partition flange 7 so that the under thread facilely passes over the partition flange 7. Between the first flange 6*b* and the partition flange 7, there is formed a first winding portion 8*a* on which a relatively large amount of the under thread is wound. Between the second flange 6*c* and the partition flange 7, there is formed a second winding portion 8*b* on which a relatively small amount of the under thread is wound.

As described above, a reason why the amount of the under thread wound on each winding portion 8*a*, 8*b* is different is that the wound amount of the under thread is restricted by the a plurality of trough portions 7*a* and ridge portions 7*b* formed at the partition flange 7 as well as a width or height of each flange 6*b*, 6*c* formed at both ends of the winding shaft 6*a*.

In the bobbin having the partition flange at the center portion thereof, the wound amount of the under thread is somewhat increased. However, there are also some problems. The problems will be described below.

FIG. 2*b* is a perspective view showing a state that an under thread is pulled out of the conventional bobbin of FIG. 2*a*. An "A" designates the under thread passed over from the second winding portion 8*b* to the first winding portion 8*a*. A portion, over which the under thread is passed, is correspondent to a boundary portion between the rough portion 7*a* and the ridge portion 7*b*. However, it is not consistent. In this situation, before the under thread wound on one winding region is completely pulled out and the winding region is then changed to the other winding region beyond the partition flange during the sewing operation, the under thread in the state of "A" may be previously slipped off from the trough portion or the ridge portion of the partition flange in an arrow direction due to rotation of the bobbin and then changed in a state of "B". If the under thread is previously slipped off, the slipped under thread is not deviated from the bobbin for a time period as long as a length of the slipped under thread and thus entangled with other under thread which is continuously pulled out. As the result, the under thread is not normally supplied to the sewing region. The under thread will be cut by such phenomenon in the end. Accordingly, the sewing operation is stopped, thereby lowering workability and also reducing the quality of a sewn product.

DISCLOSURE OF THE INVENTION

Therefore, it is an object of the present invention to provide a bobbin for a sewing machine, which is capable of preventing an under thread from being entangled or cut when being pulled out of the bobbin.

It is other object of the present invention to provide a bobbin for a sewing machine, which is capable of preventing an under thread from being previously slipped off when the under thread passes over a partition flange between a first winding portion and a second winding portion.

To accomplish the above objects and advantages, there is provided a bobbin for a sewing machine comprising a winding shaft which is separatably inserted onto a fixing shaft of the rotary shuttle device and on which the under thread is substantially wound, a first flange which is integrally formed at one end of the winding shaft, a second flange which is integrally formed at the other end of the winding shaft and a partition flange for forming a first winding portion between the first flange and the partition flange and a second winding portion between the second flange and the partition flange, characterized in that a plurality of trough portions and ridge portions are alternately formed at an entire outer circumference of the partition flange, each of the trough portions and the ridge portions has the same gradient each other, and a side portion is formed at both sides of each trough portion to prevent the under thread from being previously slipped.

BRIEF DESCRIPTION OF THE DRAWINGS

The above object, other features and advantages of the present invention will become more apparent by describing the preferred embodiment thereof with reference to the accompanying drawings, in which.

BEST MODE FOR CARRYING OUT THE INVENTION

Now, preferred embodiments of the present invention will be described in detail with reference to the annexed drawings.

Figure 1:
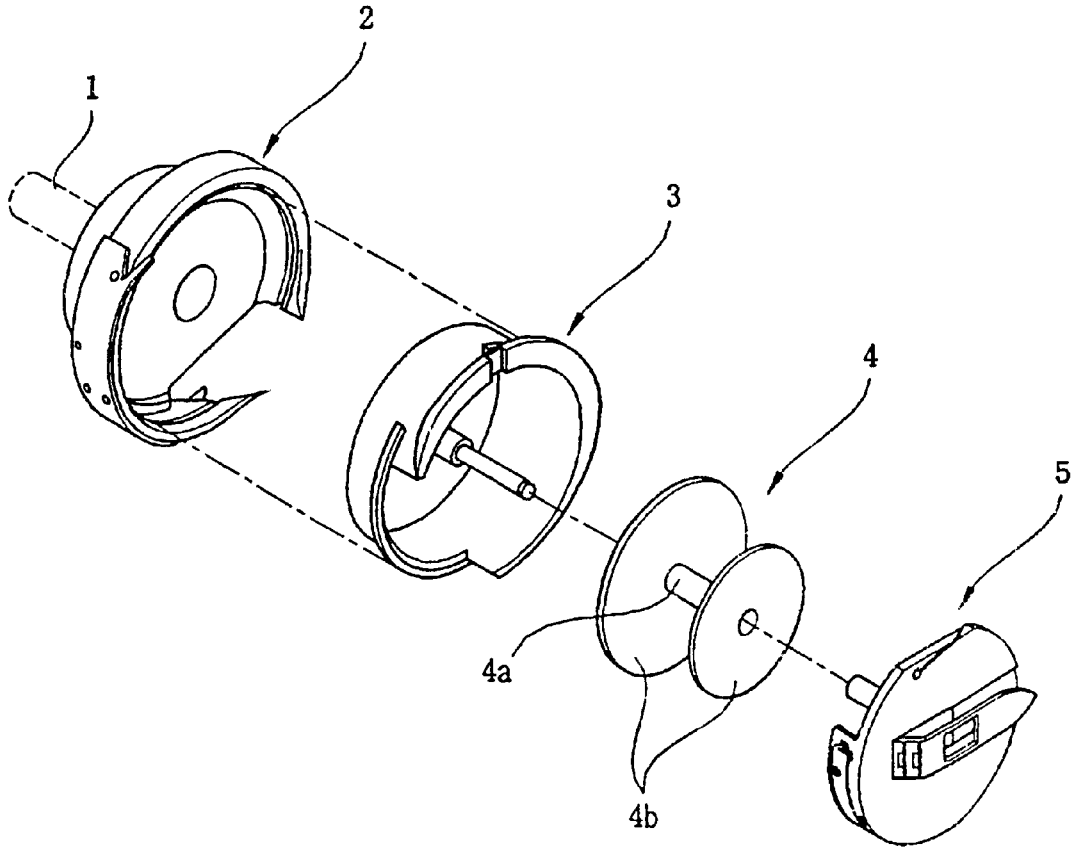
FIG. 1 is an exploded perspective view of a conventional rotary shuttle device for a sewing machine.
Figure 2A:
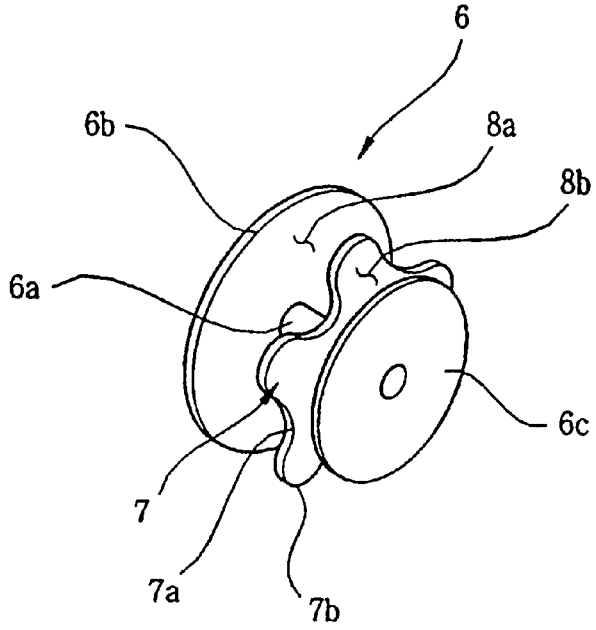
FIG. 2*a* is a perspective view of a conventional bobbin.
Figure 2B:
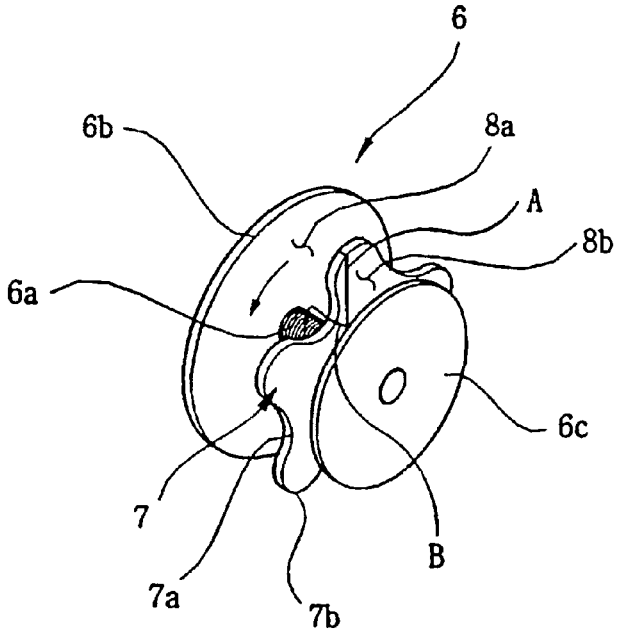
FIG. 2*b* is a perspective view showing a state that an under thread is pulled out of the conventional bobbin of FIG. 2*a;*
Figure 3:
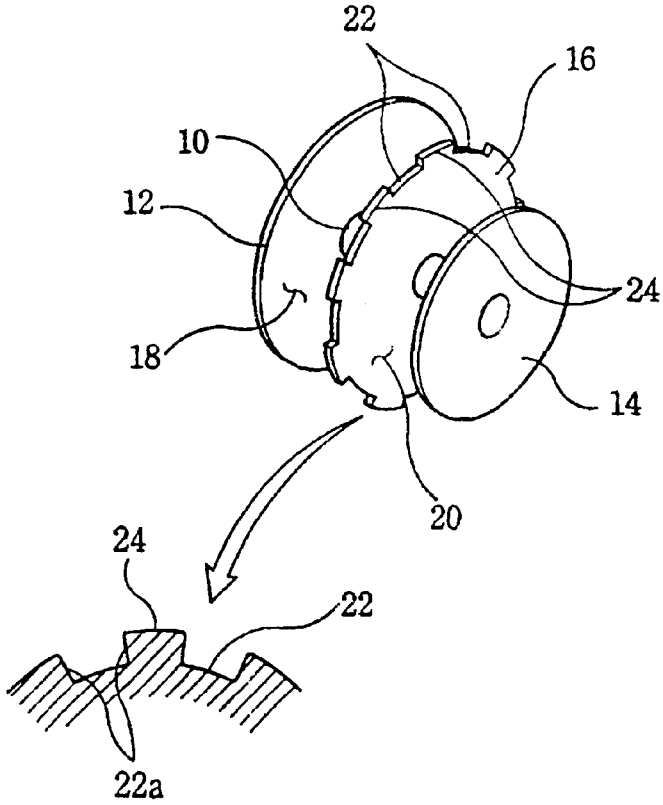
FIG. 3 is a perspective view of a bobbin for a sewing machine according to a first embodiment of the present invention.
Figure 4:
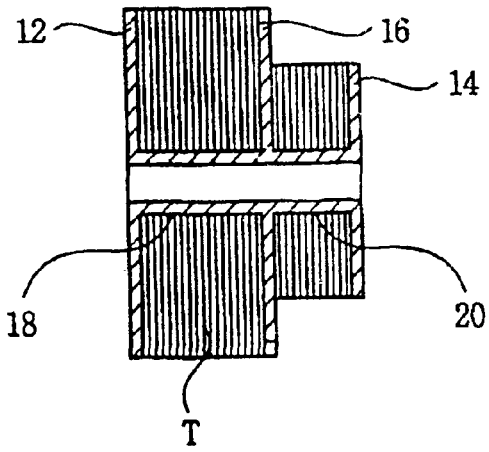
FIG. 4 is a cross-sectional view showing a state that a thread is wound on the bobbin of FIG. 3.

FIG. 3 is a perspective view of a bobbin for a sewing machine according to a first embodiment of the present invention, and FIG. 4 is a cross-sectional view showing a state that a thread is wound on the bobbin of FIG. 3, a bobbin for a sewing machine according to the present invention basically has two winding portions for winding an under thread. That is, the bobbin is removably inserted onto a fixing shaft (not shown) of a rotary shuttle device and has a cylindrical winding shaft 10 on which the under thread is substantially wound. At one end of the winding shaft 10, there is integrally formed a first flange 12 having a relatively large diameter. And at the other end of the winding shaft 10, there is integrally formed a second flange 14 having a smaller diameter than that of the first flange 12. Further, a partition flange 16 is integrally formed at a place between the first and second flange 12, 14 formed at both ends of the winding shaft 10. Therefore, due to the partition flange 16, between the first flange 12 and the partition flange 16 is formed a first winding portion 18 on which a relatively much more amount of under thread is wound, and between the second flange 14 and the partition flange 16 is formed a second winding portion 20 on which a relatively less amount of under thread is wound.

Herein, the first winding portion 18 is defined as a region on which the relatively more amount of under thread is wound. The second wind portion 20 is defined as a region on which the relatively less amount of under thread is wound and a sewing needle is reciprocated up and down. Of course, a maximum amount of the under thread wound on the second winding portion 20 is set to an amount of the thread that is not contacted with the maximally descended sewing needle. This is to prevent the under thread from being damaged or cut by the sewing needle.

Particularly, a plurality of trough portions 22 and ridge portions 24 are alternately formed along an entire outer circumference of the partition flange 16 provided at a place of the winding shaft 10. Each of the trough portions 22 and the ridge portions 24 has the same curvature or gradient each other. In addition, the number of the trough portions 22 is the same as that of the ridge portions 24. For example, the partition flange 16 is formed with 4 to 12 trough portions 22 and ridge portions 24, preferably 6 to 12 trough portions 22 and ridge portions 24, and more preferably 8 trough portions 22 and ridge portions 24.

Moreover, a side portion 22*a* is served as a connecting portion between the trough portion 22 and the ridge portion 24 to restrict a size of the trough portion 22 and the ridge portion 24. Preferably, the side portion 22*a* is form in the shape of a linear line directed in a counterclockwise direction. This is to prevent the under thread from being previously slipped from the trough portion 22. That is, after the under thread is completely pulled out of the first winding portion 18, the under thread is temporally supported to prevent the under thread from being previously slipped from one of the trough portions 22 of the partition flange 16. Then, the under thread is slipped off at a desired position and time.

Figure 6:
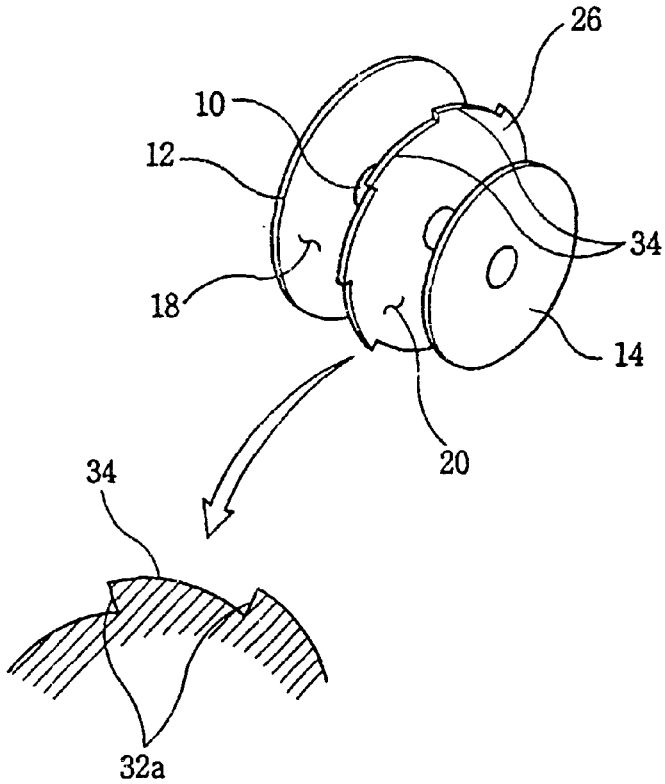
FIG. 6 is a perspective view of a bobbin for a sewing machine according to a second embodiment of the present invention.

Meanwhile, FIG. 6 is a perspective view of the bobbin of the sewing machine according to a second embodiment of the present invention. The bobbin in the embodiment is proposed to solve a problem that may be occurred. The bobbin has a partition flange 26 integrally formed between a first flange 12 and a second flange 14. On the entire outer circumference of the partition flange 26, there are formed a plurality of saw-toothed protrusions 34. Each of the saw-toothed protrusions 34 has a linear sidewall 32*a* that is orientated in a radial direction of the partition flange 26. Preferably, the saw-toothed protrusion 34 is formed in the shape of an arc, or may be formed in the shape of an liner line or a curved line.

Figure 5A:
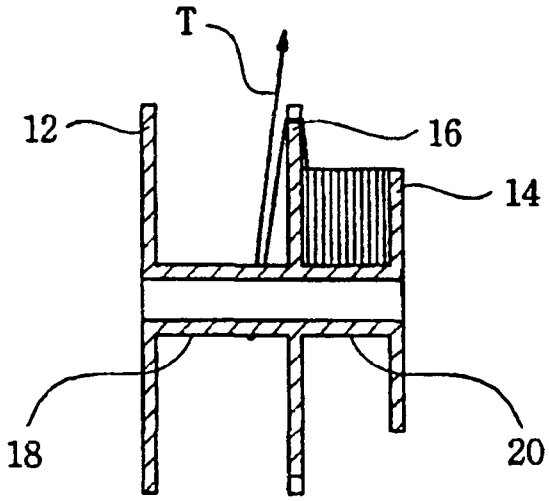
FIGS. 5*a* to 5*c* are sectional-views showing a state that the thread is pulled out.
Figure 5B:
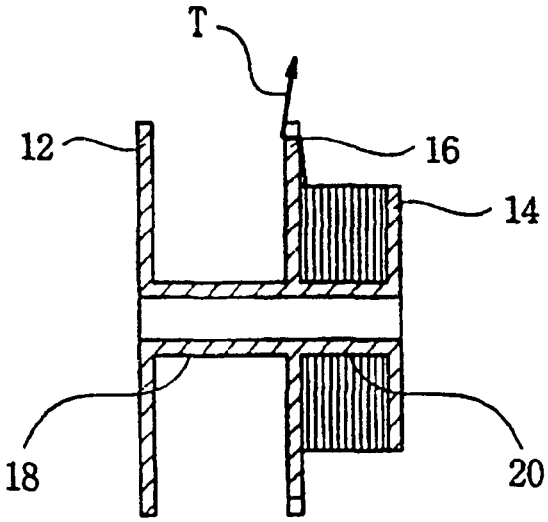
Figure 5C:
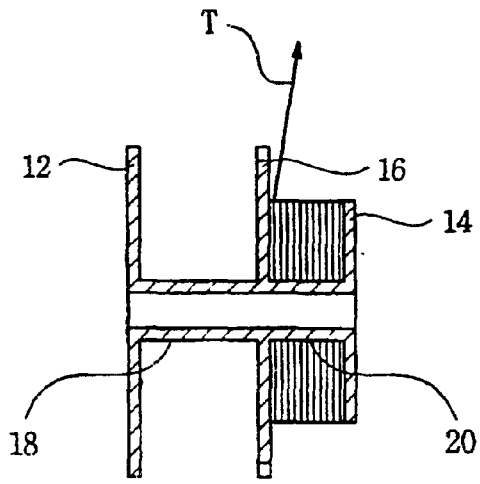

Hereinafter, an operating mode of the bobbin for the sewing machine according to the first embodiment of the present invention is described in detain with reference to FIGS. 5*a* to 5*c*.

The under thread is wound on the bobbin in a prescribed method using a thread winding device or a winder. The under thread T is wound on the second winding portion 20, and passes one of the trough portions 22 of the partition flange 16, and then wound on the first winding portion 18.

In this situation, if the sewing operation is started, the under thread wound on the first winding portion 18 of the bobbin is pulled out, while being rotated in an opposite direction to a wound direction of the under thread. After the under thread T is completely pulled out of the first winding portion 18, the under thread goes over the trough portion 22 of the partition flange 16 and then is pulled out of the second winding portion 20. At this time, while the bobbin is continuously rotated, the under thread is maintained on the trough portion 22 by the side portion 22*a* of the trough portion 22 without slipping of the under thread from the trough portion 22. Only when the under thread is pulled out toward the sewing region with a desired tensile force, the under thread goes over the second winding portion 20 and is then pulled out, thereby preventing the under thread from being previously slipped and thus completely preventing an extra portion of the under thread T which is not supplied to the sewing region from being entangled with the under thread successively pulled out. Therefore, the under thread can be supplied to the sewing region in a prescribed tensile force and speed. Herein, the extra portion is corresponding to the under thread from the winding shaft of the first winding portion 18 to an outmost portion of the second winding portion 20.

Meanwhile, the bobbin of the second embodiment is operated similarly to that of the first embodiment. However, there is a difference therebetween as follows.

Figure 7:
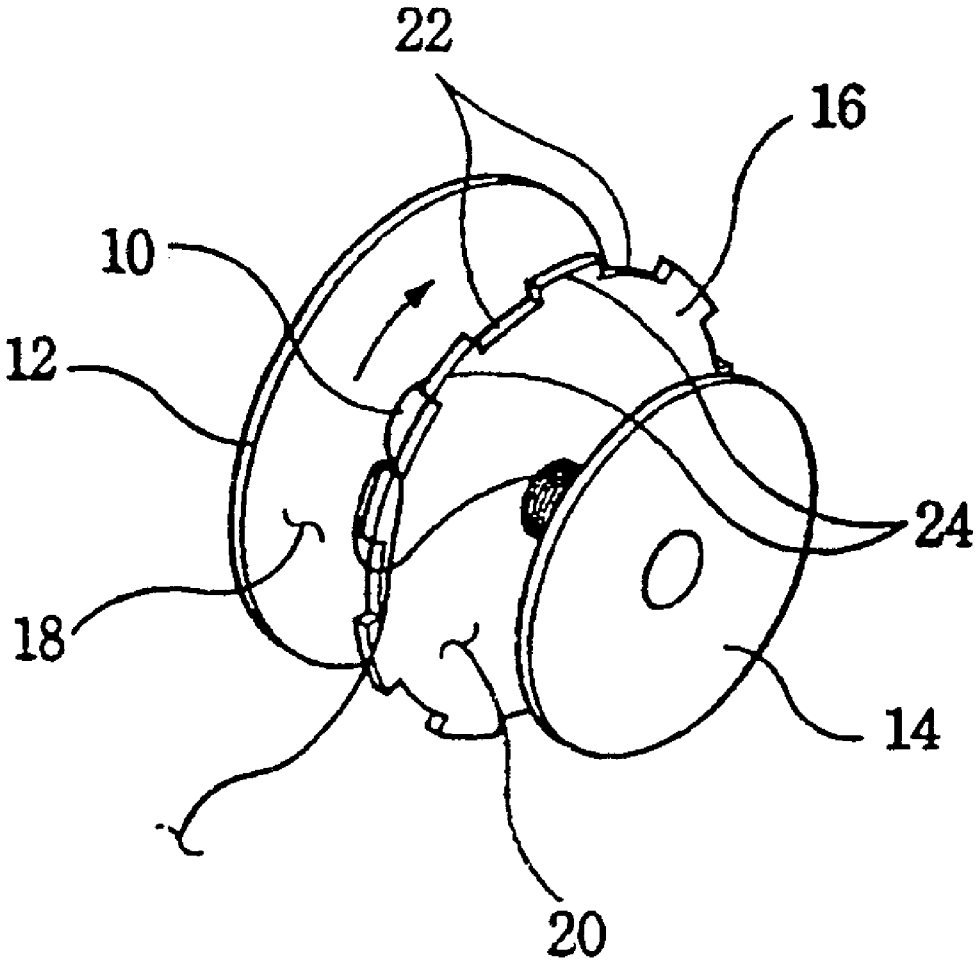
FIG. 7 is a perspective view showing a state that the under thread is caught on a partition flange of the bobbin for the sewing machine of the first embodiment of the present invention.

FIG. 7 a perspective view showing a state that the under thread is caught on a partition flange of the bobbin for the sewing machine of the first embodiment of the present invention. In case the under thread is loosened due to pause of the sewing operation, etc., and the loosened under thread is caught on a sidewall 22*a*, as shown in FIG. 7, and then the bobbin is rotated in an arrow direction to which the under thread is released, the caught under thread may be cut or tangled.

The second embodiment of the present is provided to solve the above problem. The partition flange 26 of the second embodiment has the saw-toothed protrusions which are protruded in only one direction to which the under thread is wound. Therefore, it is completely prevented that the under thread is cut or tangled.

Accordingly, the under thread pulled out of the bobbin is passed through the bobbin case in an optimal direction and tensile force without any damage or cut of the under thread, and then supplied to the sewing region, thereby facilely performing the sewing operation.

According to the bobbin for the sewing machine according to the present invention, when the under thread wound on the bobbin is pulled out of the first winding portion and then goes over the second winding portion, it is prevented that the under thread is previously slipped from the trough portion of the partition flange and entangled with the under thread successively pulled out and also the under thread is cut by the entanglement, thereby improving reliability and economy.

Moreover, since the under thread is continuously supplied without stopping, it is also prevented that the sewing operation is stopped, thereby improving workability.

While the present invention has been described in detail, those skilled in the art will appreciate that various modifications and substitutions can be made thereto without departing from the spirit and scope of the present invention as set forth in the appended claims.

What is claimed is:

1. The bobbin for a sewing machine, which is rotatably disposed in a rotary shuttle device of the sewing machine to supply an under thread when performing a sewing operation, comprising a winding shaft which is separately inserted onto a fixing shaft of the rotary shuttle device and on which the under thread is substantially wound, a first flange which is integrally formed at one end of the winding shaft, a second flange which is integrally formed at the other end of the winding shaft, and a partition flange for forming a first winding portion between the first flange and the partition flange and forming a second winding portion between the second flange and the partition flange, wherein a plurality of saw-toothed protrusions is formed at an entire outer circumference of the partition flange, and the protrusions has a linear sidewall that is orientated in a radial direction of the partition flange.

* * * * *